US011760517B2

(12) United States Patent
Otxoa-Aizpurua Calvo et al.

(10) Patent No.: US 11,760,517 B2
(45) Date of Patent: Sep. 19, 2023

(54) VERTICAL PACKAGING MACHINE

(71) Applicant: ULMA Packaging, S. Coop., Oñati (ES)

(72) Inventors: Alberto Otxoa-Aizpurua Calvo, Oñati (ES); Maitane Ayala Martín, Oñati (ES)

(73) Assignee: ULMA PACKAGING, S. COOP, Oñati (ES)

( * ) Notice: Subject to any disclaimer, the term of this patent is extended or adjusted under 35 U.S.C. 154(b) by 32 days.

(21) Appl. No.: 17/711,486

(22) Filed: Apr. 1, 2022

(65) Prior Publication Data

US 2022/0363420 A1 Nov. 17, 2022

(30) Foreign Application Priority Data

May 14, 2021 (EP) ..... 21382449

(51) Int. Cl.
*B65B 31/04* (2006.01)
*B65B 9/20* (2012.01)
(Continued)

(52) U.S. Cl.
CPC ..... *B65B 31/045* (2013.01); *B65B 9/20* (2013.01); *B65B 37/02* (2013.01); *B65B 37/14* (2013.01)

(58) Field of Classification Search
CPC ..... B65B 37/02; B65B 37/14; B65B 9/10–22; B65B 31/045
See application file for complete search history.

(56) References Cited

U.S. PATENT DOCUMENTS 2,187,688 A * 1/1940 Hopkins ..... B65B 31/045 426/395
3,482,373 A * 12/1969 Morris ..... B65B 31/045 53/511

(Continued)

FOREIGN PATENT DOCUMENTS

EP 0192604 A1 8/1986
EP 3530575 A1 8/2019

OTHER PUBLICATIONS

European Search Report, EP21382449, dated Oct. 21, 2021, 5 pages.

*Primary Examiner* — Anna K Kinsaul
*Assistant Examiner* — Himchan Song
(74) *Attorney, Agent, or Firm* — Edell, Shapiro & Finnan, LLC

(57) ABSTRACT

Disclosed is a vertical packaging machine configured for packaging a product. The machine may include a supply conduit formed by at least one hopper through which the product to be packaged is introduced in the supply conduit. A tube is arranged downstream the hopper. The supply conduit includes at least a first passage conduit and a second passage conduit which are separated from one another such that each of the first and passage conduits offers a different path for the product to be packaged. Each of the first and second passage conduits includes a first injection opening and a second injection opening, the first injection openings being located at different heights and in different angular positions in reference to the second injection openings. The machine also includes one or more injection devices and that are configured to inject gas into the first and second gas injection openings.

19 Claims, 8 Drawing Sheets

(51) Int. Cl.
*B65B 37/02* (2006.01)
*B65B 37/14* (2006.01)

(56) References Cited

U.S. PATENT DOCUMENTS 3,528,214 A * 9/1970 Calvano ..... B65B 51/303 53/511
3,579,945 A * 5/1971 Buchner ..... B65B 31/045 53/511
3,664,086 A * 5/1972 James ..... B65B 55/19 53/511
3,789,888 A * 2/1974 James ..... B65B 9/213 53/433
4,738,287 A 4/1988 Klinkel
5,473,866 A * 12/1995 Maglecic ..... B65B 1/32 53/511
6,179,015 B1 1/2001 Kammler et al.
2005/0172582 A1* 8/2005 Taylor ..... B65B 9/22 53/511
2018/0086487 A1* 3/2018 Grus ..... B65B 39/007
2019/0254296 A1* 8/2019 Otxoa-Aizpurua Calvo ..... B65B 9/20
2021/0394938 A1* 12/2021 Ferrarini ..... B65B 31/02
2021/0394941 A1* 12/2021 Anzaldi ..... B65B 31/045
2022/0024619 A1* 1/2022 Anzaldi ..... B65B 55/103
2022/0161954 A1* 5/2022 Garuti ..... B65B 31/045
2022/0289411 A1* 9/2022 Yamane ..... B65B 51/303

* cited by examiner

VERTICAL PACKAGING MACHINE

CROSS-REFERENCE TO RELATED APPLICATIONS

This application relates to and claims the benefit and priority to European Application No. EP21382449.3, filed May 14, 2021.

FIELD

The present invention relates to packaging machines and in particular to vertical packaging machines.

BACKGROUND

Some types of conventional packaging machines, in particular vertical packaging machines, comprise a feed device for supplying a continuous film which is wound in the form of a reel. The film is supplied to a vertical forming element, which imparts a tubular shape to said film. The machine also comprises a supply conduit through which the product to be packaged falls, formed by at least one hopper through which said products are introduced in the supply conduit, and a tube which is arranged downstream of the hopper. The machine comprises a drive device for driving the tubular shaped film in a downward forward movement direction, around the tube, and at least one longitudinal cutting tool sealing the longitudinal ends of the tubular shaped film to one another, a film tube thus being generated. The supply conduit is a hollow conduit which is open at the upper part thereof (the inlet of the hopper) and at the lower part thereof (the outlet of the tube).

A machine of this type further comprises a transverse sealing and cutting tool, arranged downstream of the tube, for generating a transverse sealing and a transverse cutting in the film tube. After this operation (or operations), there is obtained a film tube closed at one end upstream of the transverse cutting, and a package closed at both ends downstream of the transverse cutting and physically separated from the film tube. During said operation (or operations) the most upstream end of the package is closed, whereas the most downstream closed end corresponds with the closed end of the film tube from the previous cycle, i.e., the transverse sealing providing the closing of an end of the film tube will be a closed end of the package obtained in the following cycle.

The product is introduced in the supply conduit at the upper part thereof and exits at the lower part thereof towards the transverse sealing of the film tube. It must be borne in mind that the film tube surrounds the tube of the supply conduit, such that when the product is introduced in the supply conduit, said product is also introduced in the film tube.

The product is supplied in a controlled manner from the hopper (or from upstream of the hopper), a predetermined amount being supplied each time, which amount corresponds to the amount of product to be packaged in each package.

U.S. Pat. No. 6,179,015B1 and EP3530575A1 disclose a vertical packaging machine comprising a supply conduit through which the product to be supplied falls. The machine further comprises an injection device configured for injecting a gaseous fluid into the supply conduit, and a control device configured for controlling the injection of fluid.

SUMMARY

Disclosed is a machine that is configured for packaging products, in particular for packaging fruit and vegetable products such as spinach leaves, lettuce, parsley, or other products of that type, for example, the characteristics of which (low unitary weight and large surface area) cause a slow rate of fall due to gravity and a high risk of jamming in regions in which the area of passage of the product is reduced.

The machine comprises a supply conduit through which the product to be packaged falls and an injection device configured for injecting a gaseous fluid into the supply conduit, the supply conduit being formed by at least one hopper through which said product to be packaged is introduced in the supply conduit and a tube which is arranged downstream of the main hopper.

The supply conduit is divided into at least a first passage conduit with a corresponding central axis and a second passage conduit with a corresponding central axis, in a bifurcation zone which is upstream of the tube. Said passage conduits are separated from one another such that each passage conduit offers a different path in said bifurcation zone for the product to be packaged.

Each passage conduit comprises at least a first injection opening and a second injection opening arranged at different heights and in different angular positions with respect to the corresponding central axis, and communicated with the injection device, through which the gaseous fluid enters the supply conduit. Said injection device and/or injection openings are configured for the gaseous fluid to enter the supply conduit in a downward direction.

Therefore, as two different paths are defined for the product to be packaged and as the injection device is associated with each path through the corresponding injection openings of each passage conduit, the falling of the product through the supply conduit is accelerated while at the same time the risk of said product, or part of it, becoming jammed in said supply conduit is reduced.

With the proposed machine, gaseous fluid is injected upstream of the tube, with said injection causing at least part of the air present in the corresponding passage conduit above each injection opening to follow such injected fluid and to increase its rate of fall, due to the effect known as the Venturi effect, negative pressure thus being generated upstream of each injection opening and the part of the product to be packaged which is above the corresponding injection opening being attracted by suction. The product thereby reaches the tube in an accelerated state in its path with respect to the absence of the injection of a gaseous fluid as described, which facilitates its entry into said tube and prevents, to a greater extent, said product becoming jammed at the inlet of the tube.

Furthermore, having at least two paths for the product causes the product to be divided into different parts as it falls through the inside of the hopper (as many parts as there are paths) and the injected fluid accelerates the entirety of the product to be packaged (including those leaves or bunches of the product falling in regions far away from the surface demarcating the supply conduit), since the negative pressure generated upstream of the injection openings causes an air stream in each passage conduit which is introduced not only in the proximity of the surface of said passage conduit (unlike what occurs in conduits having a large diameter due to the Coandă effect) but also through the central region thereof, thus forcing the entirety of the product of said passage conduit in the downward direction, so even if a tube with an inlet opening having a large diameter is used, with the injection of fluid associated with each of the passage conduits the suction effect is multiplied, which prevents parts of the product to be packaged not being accelerated, as would be the case of the product falling through the center of a conventional hopper having dimensions in accordance with the diameter of the tube inlet opening, furthermore achieving a higher rate of packaging.

Additionally, having injection openings at different heights associated with each passage conduit allows for not the entirety of the product (part of the corresponding product) falling through a passage conduit to be accelerated by said injection of gaseous fluid in the same way (and/or at the same time), with said product reaching the inlet of the tube in a "stretched out" manner, i.e., part of the product reaches said inlet before another part of said product does, thus going through said inlet of the tube in a progressive manner. The possibility of said product becoming jammed in the supply conduit, particularly at the inlet of the tube, which is usually the most problematic point in a vertical packaging machine, is thus prevented to a greater extent.

Therefore, a faster packaging machine is obtained as the acceleration of the entirety of the part of the product passing through each passage conduit is ensured, a more effective packaging machine is obtained as the risk of jamming is reduced due to the stretched out shape conferred to the accelerated product as a consequence of the distribution of the injection openings, a more versatile packaging machine capable of using a tube having a larger diameter (even further reducing, if possible, the risk of jamming) is obtained, and a packaging machine capable of reducing film consumption is obtained as the machine generates packages that are wider (as tubes having a larger diameter are allowed) and shorter (as the product is compacted to a greater extent due to the effect of the rate of fall upon reaching the end of its path), for one and the same amount of product to be packaged.

These and other advantages and features will become apparent in view of the figures and the detailed description.

DETAILED DESCRIPTION

Figure 1:
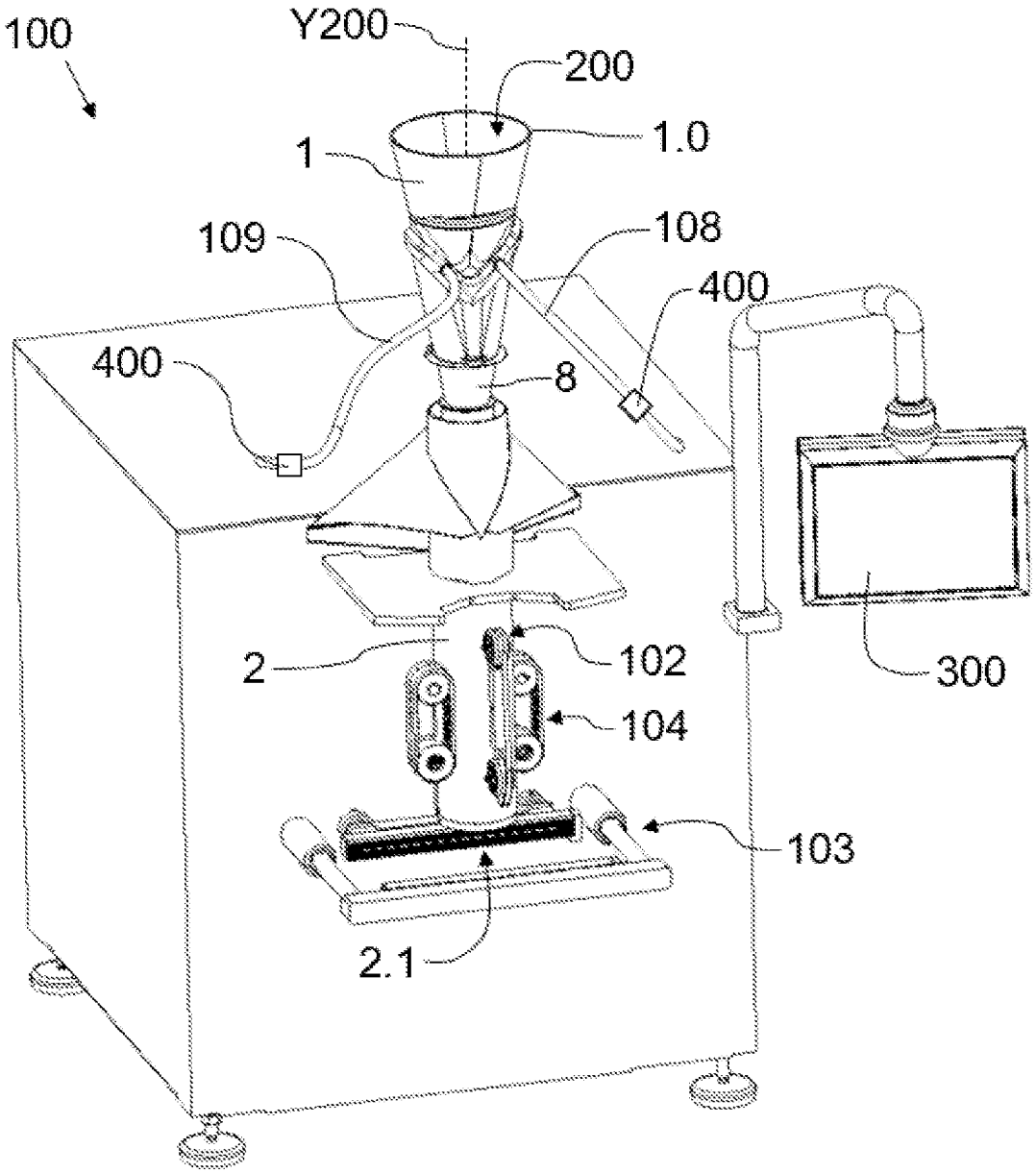
FIG. 1 illustrates a vertical packaging machine according to one embodiment.

The vertical packaging machine 100 is particularly suited or designed for packaging horticultural-type products, of the type packaged in the form of sprouts, leaves, or the like, such as the cut up lettuce leaves or another type of vegetable (parsley, etc.) having a low unitary weight and large surface area conferring on them a slow rate of fall due to gravity. Said machine 100, depicted by way of example in the embodiments of FIGS. 1 and 2, comprises a supply conduit 200 with its corresponding central axis Y200, through which the product to be packaged falls, and, preferably, it further comprises a weighing machine upstream of the supply conduit 200, for example a multi-head weighing machine, which feeds a given weight of product (or a given amount of product) to said supply conduit 200, for each package to be generated.

The supply conduit 200 of the machine 100 is formed by at least one hopper 1, which receives the products to be packaged, and a tube 2 which is arranged downstream of the hopper 1 and which is preferably vertical (although it could have an angle of inclination of up to 45° with respect to the vertical). In particular, the supply conduit 200 is formed by at least said hopper 1 and said tube 2 (by the inside of the tube 2 and of the hopper 1), which are communicated to one another.

The product is introduced in the supply conduit 200 through the hopper 1, and the diameter of said hopper 1 gradually decreases upon approaching the tube 2. The tube 2 comprises a tube inlet opening 2.0 depicted in FIG. 3, through which the product enters said tube 2 from the hopper 1, and a tube outlet opening 2.1 downstream of the tube inlet opening 2.0 through which the product exits the tube 2.

The machine 100 comprises a film feed device not depicted in the figures, configured for feeding a film to form the package. The tube 2 is configured for receiving said film and for imparting a tubular shape to same. The machine 100 further comprises a longitudinal sealing tool 102 configured for sealing the film which surrounds the tube 2 longitudinally, a film tube thus being formed, and a transverse sealing and cutting tool 103 and arranged downstream of the tube 2, for generating a transverse sealing and a transverse cutting in the film tube, a tube closed at one end being generated. The product to be packaged which falls through the supply conduit 200 is thus housed on said closed end of the film tube, and the following actuation of the transverse sealing and cutting tool 103 separates a piece of film tube from the rest (a piece comprising the closed end and the product therein) and closes the other end of said piece by sealing, the final package (the piece of film tube separated from the rest and closed) thus being generated. The film tube is moved by the action of a drive device 104.

The machine 100 further comprises an injection device configured for injecting a gaseous fluid into the supply conduit 200, and with said injection accelerating the falling of the product to be packaged through the supply conduit 200.

Figure 3:
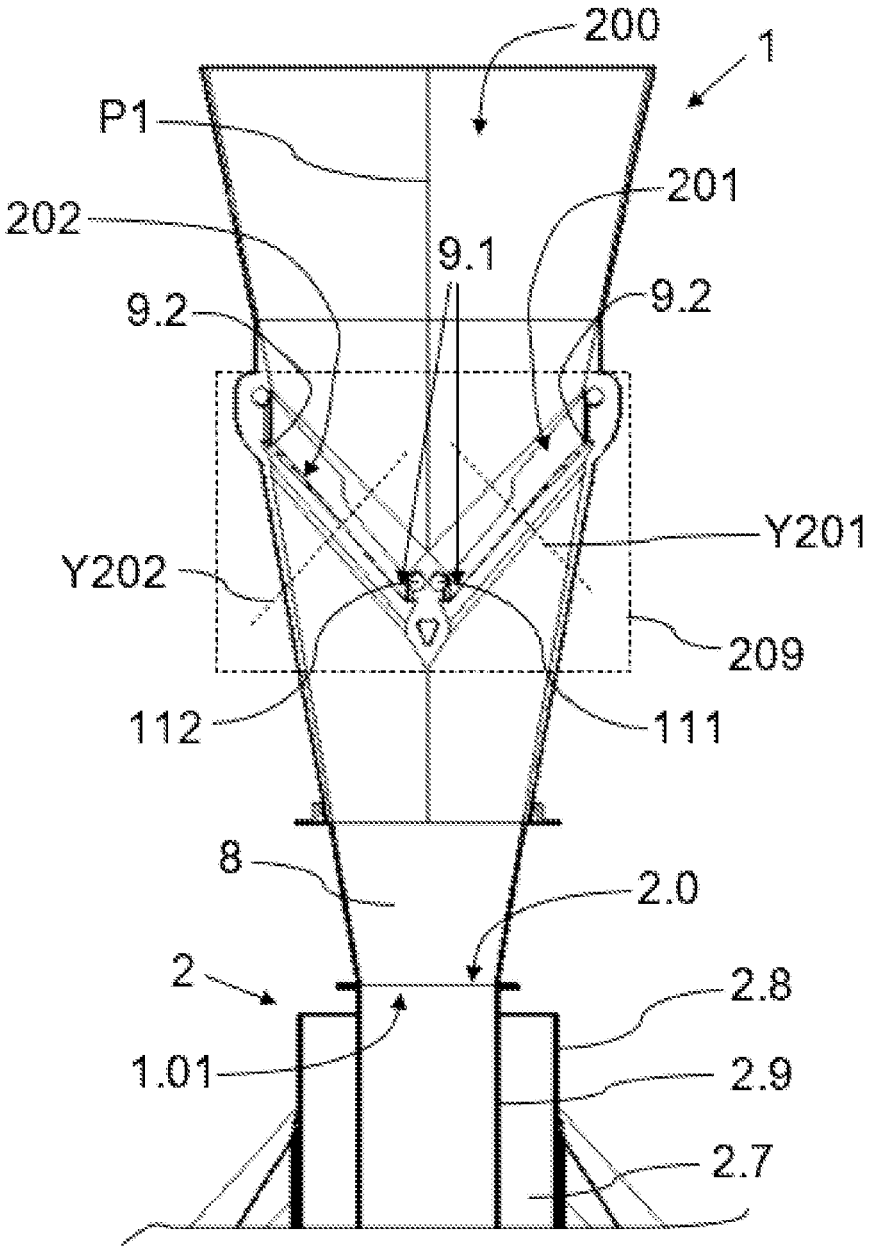
FIG. 3 shows a section view of a hopper and part of a tube of the machine of FIG. 1.
Figure 4:
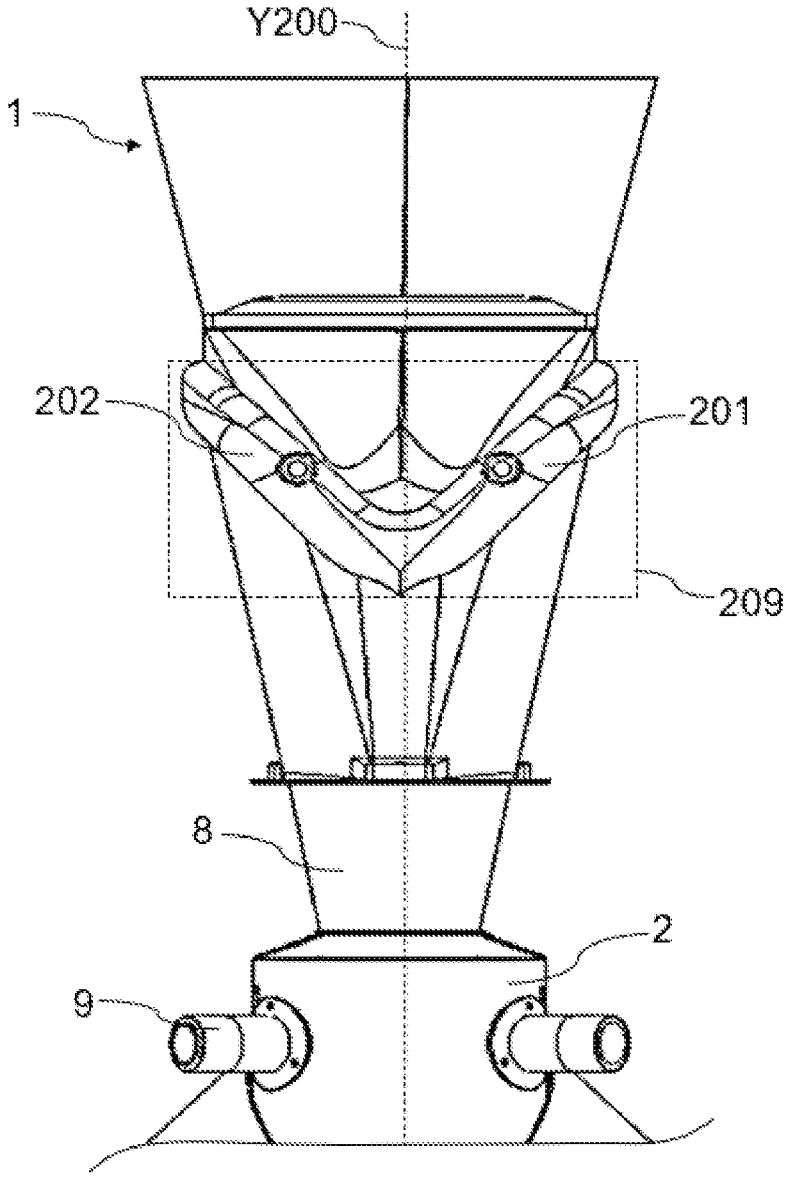
FIG. 4 shows a view of a hopper and part of a tube of the machine of FIG. 2.
Figure 5:
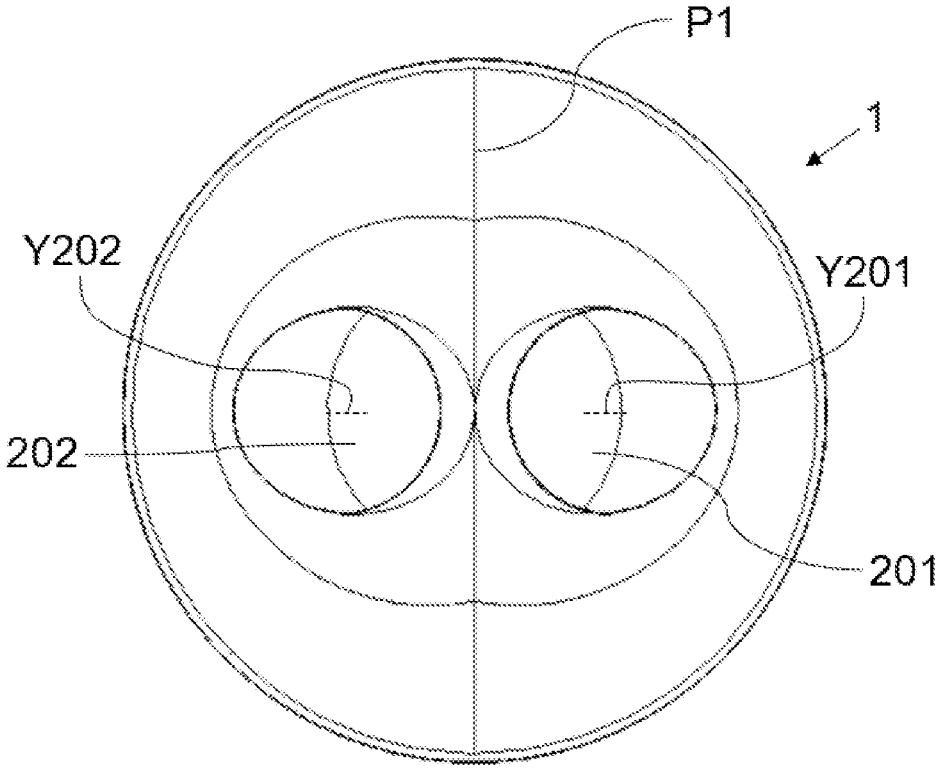
FIG. 5 is a plan view of the hopper of the machine of FIG. 2.

The supply conduit 200 is divided into at least a first passage conduit 201 with a corresponding central axis Y201 and a second passage conduit 202 with a corresponding central axis Y202, shown in FIG. 5 by way of example, in a bifurcation zone 209 depicted in FIGS. 3 to 4, which is upstream of the tube 2, preferably in the hopper 1. Each passage conduit 201 and 202 defines a respective path for a corresponding part of the product to be packaged which is introduced in said supply conduit 200 (through the hopper 1), in said bifurcation zone 209. Preferably, the supply conduit 200 again defines a single path for the product to be packaged, downstream of said bifurcation zone 209.

Each passage conduit 201 and 202 comprises at least a first injection opening 9.1 and a second injection opening 9.2 communicated with the injection device, through which the gaseous fluid enters the supply conduit 200. The injection openings 9.1 and 9.2 of each passage conduit 201 and 202 are arranged at different heights (with respect to the tube outlet opening 2.1, for example) and in different angular positions with respect to the corresponding central axis Y201 and Y202. The injection device and/or the injection openings 9.1 and 9.2 are configured for introducing a gaseous fluid into the supply conduit 200, in a downward direction, through at least said first injection opening 9.1 arranged in each passage conduit 201 and 202, and through said second injection opening 9.2 arranged in each corresponding passage conduit 201 and 202. Preferably, each passage conduit 201 and 202 comprises a plurality of injection openings 9.3 between the first injection opening 9.1 and the second injection opening 9.2, as shown by way of example in FIG. 6. The first injection opening 9.1 will be the injection opening arranged at a greater height, and the second injection opening 9.2 will be the injection opening arranged at a lower height. Said injection or introduction of gaseous fluid causes at least part of the air present in said supply conduit 200 above the corresponding injection openings 9.1 and 9.2 to follow the injected fluid (due to the effect known as the Venture effect), driving the part of the corresponding product with it and increasing the rate of fall of said part of the product.

This causes different parts of the part of the product falling through each passage conduit 201 and 202 to be affected by the injection of gas at different heights of the supply conduit 200 (taking the tube outlet opening 2.1 as a reference, for example), and as a result, the part of the product falling through the corresponding passage conduit 201 and 202 exits said passage conduit 201 and 202 in a progressive manner, said part of the product being stretched out. A product becoming jammed in the supply conduit 200 is thereby prevented to a greater extent (given that the air stream pushes the product from the hopper 1 into the tube 2), while at the same time the rate of packaging and, therefore, productivity of the machine 100, are increased.

When a product to be packaged is introduced in the supply conduit 200 through the hopper 1, said product generally falls in the entire diameter of said supply conduit 200 during its fall. Due to the design of the supply conduit 200 of the proposed machine 100, and in particular due to the presence of a plurality of passage conduits 201 and 202, during its fall the product is divided into as many parts as there are passage conduits 201 and 202 arranged in the supply conduit 200, in the regions where the passage conduits 201 and 202 are located. Preferably the machine 100 comprises two passage conduits 201 and 202, and a part of the product falls through the first passage conduit 201 and another part falls through the second passage conduit 202. As a result of the arrangement of the injection openings 9.1 and 9.2 in each of the passage conduits 201 and 202, at different heights and in different angular positions with respect to the central axis Y201 and Y202 of the corresponding passage conduit 201 and 202, the effect generated by the injection of gaseous fluid does not affect the entirety of the product arranged along the inner perimeter of each passage conduit 201 and 202 to the same extent (with the same intensity) or at the same time (as they are in different angular positions and at different heights); it primarily affects the part of the product which is above the corresponding injection opening 9.1 and 9.2, and the part of the product that is in the part of the inner perimeter of the passage conduit 201 and 202 that is the least affected or is not affected by said injection is accelerated to a lesser (or not accelerated). Therefore, the effect of stretching out said product inside the supply conduit 200 is obtained in each of the passage conduits 201 and 202, given that the part of the product that is not affected (or is affected to a lesser extent) in the beginning by said air stream stays behind the part that is affected in said beginning (in general, the less the air stream affects a part of the product, the farther behind the part of the product that is not affected will stay).

The injection device is configured for directing the gaseous fluid into the supply conduit 200, in a downward direction, preferably with an inclination greater than 0° and less than 45° with respect to the vertical. Said air stream thereby tends to follow the contour of an inner surface of the supply conduit 200 (tends to be attracted by the inner surface of the supply conduit 200 due to the effect known as the Coandă effect). This prevents the injected fluid from generating turbulence that may negatively affect the falling of the product through the supply conduit 200, while at the same time allows suctioning the air that is located above the injection openings 9.1 and 9.2 in a more effective and targeted manner.

Offering at least two paths for the product furthermore allows a tube 2 having a large diameter to be used, given that as a result of this division and the injection of gaseous fluid into said paths, it prevents the part of the product which falls separated from the walls of the supply conduit 200 not being accelerated. This increase in diameter makes it possible to increase the rate of packaging (since it allows a larger amount of product to enter and since the falling of the product is accelerated), reduces the risk of jamming, and can reduce the amount of packaging film needed (since said product is better compacted, even if the package is wider due to the increase in the diameter of the tube 2, it is also shorter, largely reducing the amount of film used for packaging compared with a conventional machine with a tube 2 having a smaller diameter).

Figure 6:
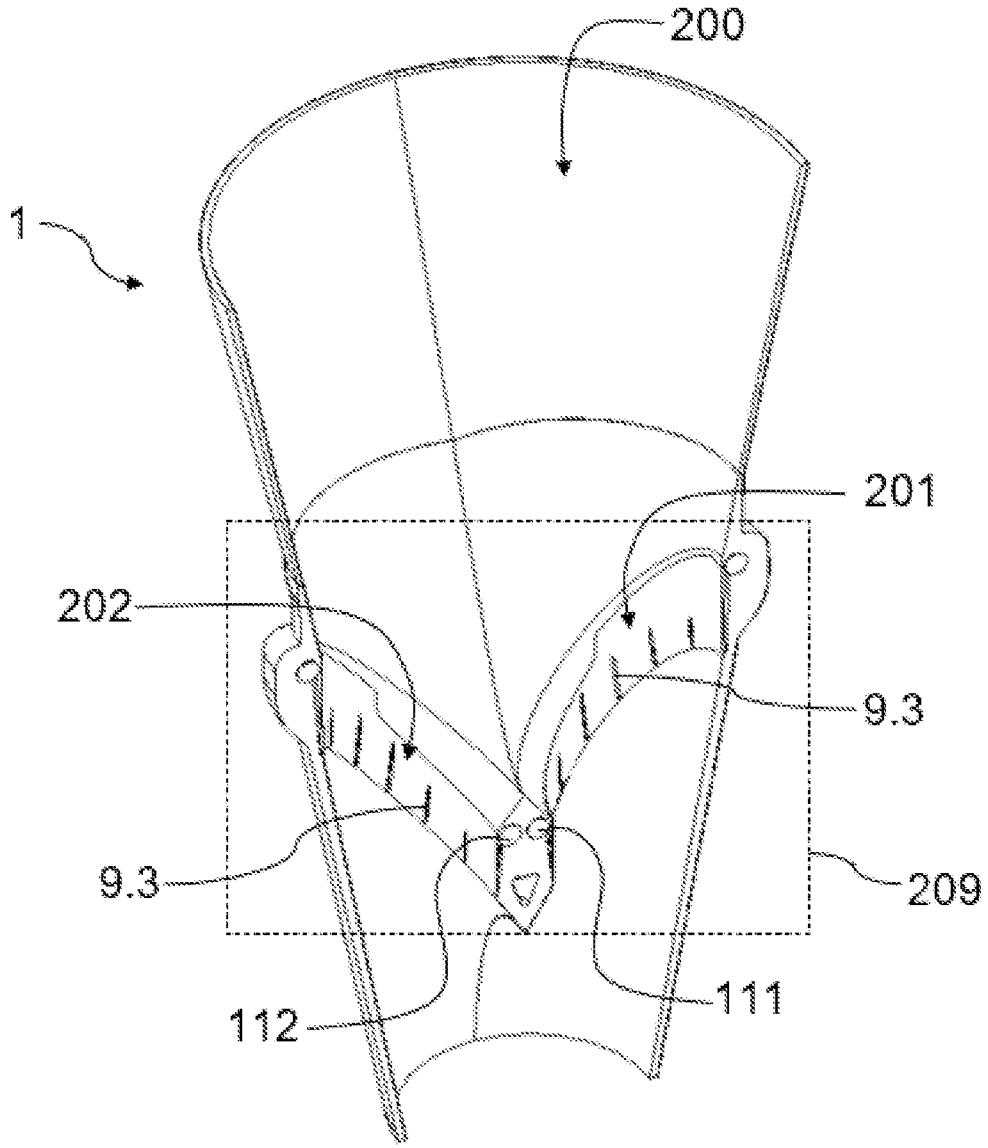
FIG. 6 shows a perspective view of the hopper of FIG. 3.

Preferably, each passage conduit 201 and 202 comprises more than two injection openings distributed around the corresponding central axis Y201 and Y202 (each passage conduit 201 and 202 comprises a plurality of openings 9.3 depicted by way of example in FIG. 6), said distribution forming a ring that is inclined with respect to the vertical. Preferably, said distribution is furthermore homogeneous, such that the entirety of the product falling through the corresponding passage conduit 201 and 202 is caused to accelerate.

Preferably, the first passage conduit 201 and the second passage conduit 202 are symmetrical with respect to an axial central plane P1 of the bifurcation zone 209 of the supply conduit 200, which facilitates the manufacture and the control of the machine 100.

Figure 7:
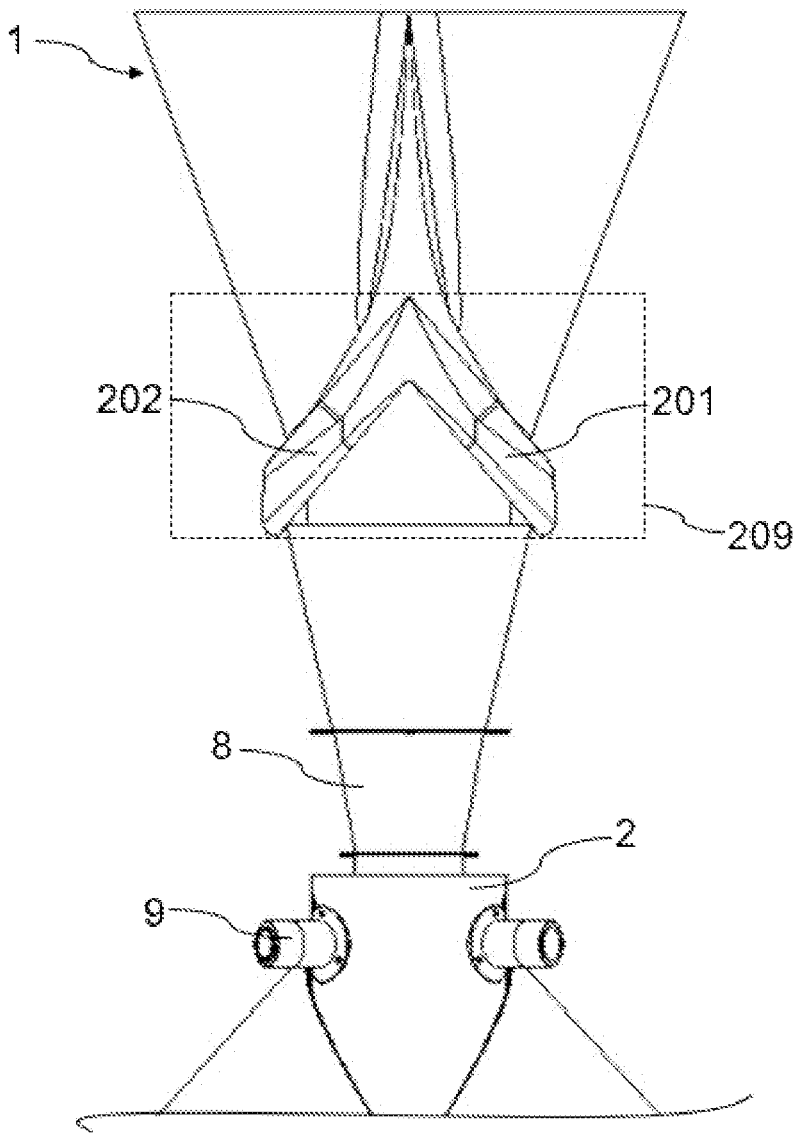
FIG. 7 shows a view of a hopper and part of a tube of another embodiment of the machine.
Figure 8:
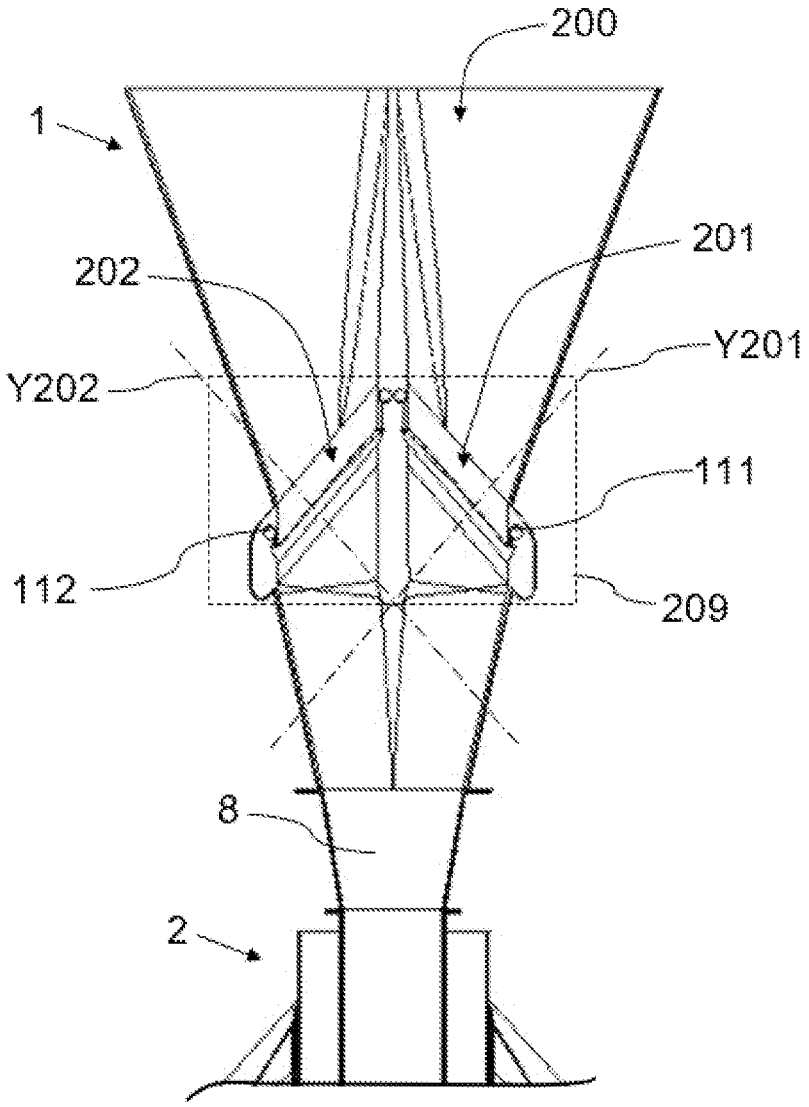
FIG. 8 is a cutaway view of the hopper and part of the tube of the machine of FIG. 7.

In some embodiments, the first injection opening 9.1 of each passage conduit 201 and 202 is at a lower height than the corresponding second injection opening 9.2 and horizontally closer to the axial central plane P1 of the bifurcation zone 209 than the corresponding second injection opening 9.2 (embodiments of FIGS. 1 to 6). In other embodiments, such as the shown in FIGS. 7 and 8, the first injection opening 9.1 of each passage conduit 201 and 202 is at a greater height than the corresponding second injection opening 9.2 and horizontally closer to the axial central plane P1 of the bifurcation zone 209 than the corresponding second injection opening 9.2.

Preferably, the injection device comprises at least a first conduit 108 communicating the passage openings 9.1 and 9.2 of the first passage conduit 201 with a source of pressurized gaseous fluid (an air intake, for example) which is preferably outside the machine 100, at least a second conduit 109 communicating the passage openings 9.1 and 9.2 of the second passage conduit 202 with said source of pressurized gaseous fluid, and a control unit 300 configured for opening or closing the passage of gaseous fluid through said conduits 108 and 109. The machine 100 preferably comprises a respective actuator 400 associated with each conduit 108 and 109, which is actuated by the control unit 300 for opening or closing the corresponding passage, where said actuators 400 can furthermore be pressure regulating elements for adjusting the pressure or speed at which the gaseous fluid is introduced in the supply conduit 200. Preferably, the control unit 300 is further configured for opening and closing the passage of both conduits 108 and 109 simultaneously.

The injection device of the machine 100 may comprise a first chamber 111 around the first passage conduit 201 and communicated with the injection openings 9.1 and 9.2 of said first passage conduit 201, being the first conduit 108 communicated with said first chamber 111, and a second chamber 112 around the second passage conduit 202 and communicated with the injection openings 9.1 and 9.2 of said second passage conduit 202, the second conduit 109 being communicated with said second chamber 112.

The injection device is configured for injecting the gaseous fluid into the supply conduit 200 at a speed and/or pressure sufficient for causing at least part of the air present in the supply conduit 200 above the corresponding injection openings 9.1 and 9.2 to follow said injected fluid.

Figure 2:
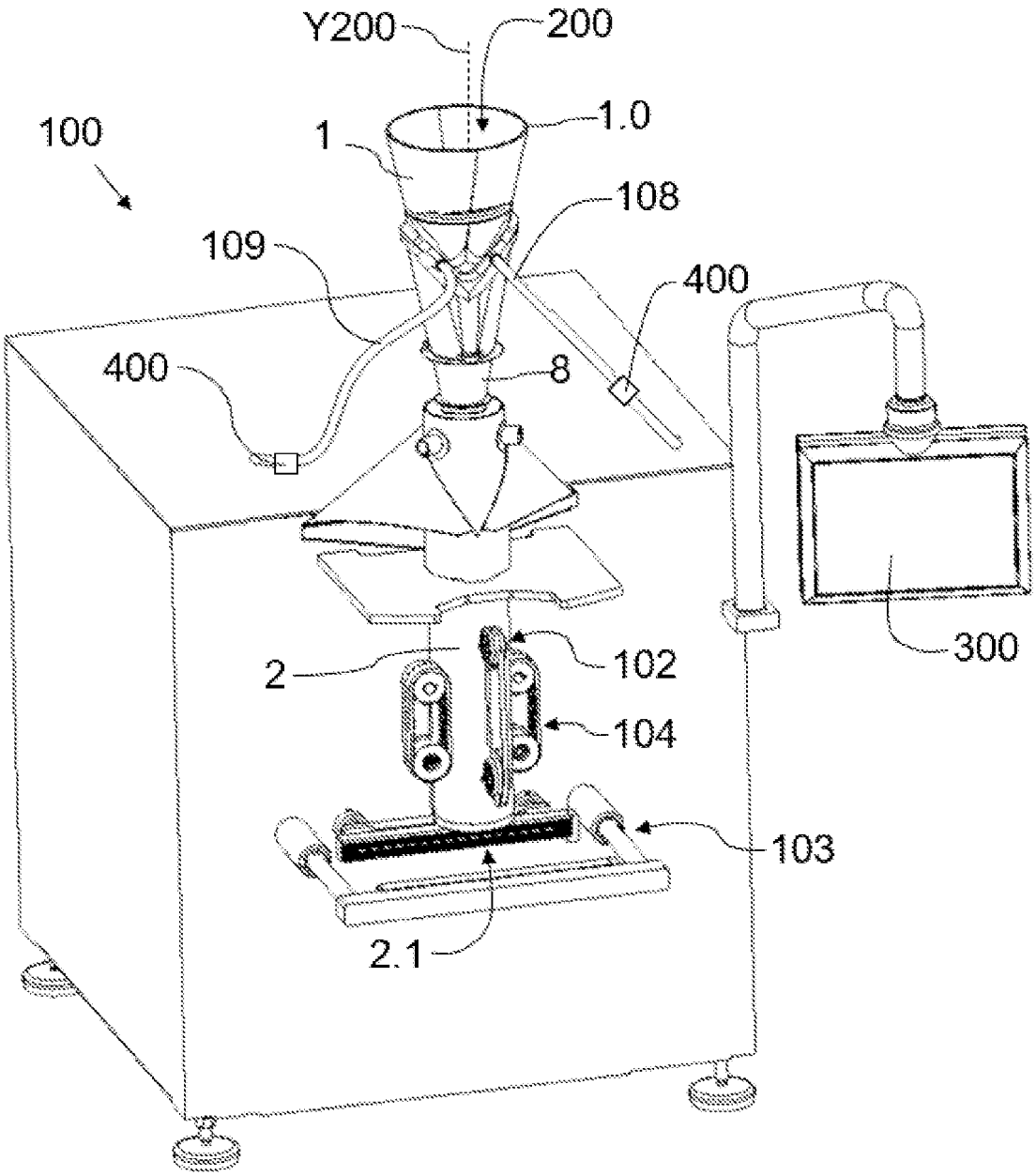
FIG. 2 illustrates a vertical packaging machine according to another embodiment.

FIG. 1 shows a first embodiment of the vertical packaging machine 100 of the invention. The hopper 1 comprises a longitudinal hopper axis (which is a central and vertical axis, but may not be vertical depending on the configuration of the hopper 1), two passage conduits 201 and 202, and a hopper outlet opening 1.01.

In the machine 100, the hopper 1 may be formed by a single element or may be formed by a plurality of hollow elements arranged one on top of the other, with each hollow element comprising its corresponding central axis. The central axes of each of the hollow elements may or may not coincide, may all be vertical, or each one may have a given angle with respect to the vertical (where any of said angles may be equal to zero).

In some embodiments, the tube 2 is connected to the hopper 1 directly. In other embodiments, the machine 100 comprises at least one intermediate hopper 8 which is arranged between the hopper 1 and the tube 2 and is part of the supply conduit 200. Said intermediate hopper 8 is suitable for connecting the tube inlet opening 2.0 of the tube 2 with the outlet areas 201.1 and 202.1 delimited by the passage conduits 201 and 202.

The tube 2 can be a coaxial tube comprising an inner tube 2.9, the inner tube 2.9 comprising the inlet opening 2.0 which receives the products from the hopper 1. In the case of a coaxial tube, the coaxial tube further comprises an outer tube 2.8 having a larger diameter than the inner tube 2.9, and an open space 2.7 is generated between both tubes 2.8 and 2.9, communicating the most upstream part thereof with the most downstream part thereof.

When a product is packaged, as described above, a film tube surrounds the tube 2 and said film tube has a closed transverse end located below the tube 2. If the tube 2 is a coaxial tube like the one previously described, the gaseous fluid that is injected into the hopper 1 as well as the generated air stream reaching the inside of the tube 2 (the inside of the inner tube 2.9 in this case) can be discharged from the tube 2 through the space 2.7, after exiting through the lower part of the inner of said inner tube 2.9, thus preventing it from being left in the final package generated or from exiting in the direction opposite the falling of the product through the inside of said inner tube 2.9. That space can be open to the atmosphere (FIG. 1), or it can be closed (FIG. 2), in which case the machine 100 may comprise an extraction device 9 suitable for extracting the gaseous fluid from the space 2.7 delimited between the inner tube 2.9 and the outer tube 2.8 of the tube 2, by suction. The extraction device 9 may comprise at least one conduit (partially shown in the figures) going through the outer tube 2.8 for communicating the space 2.7 with the outer atmosphere.

Using an extraction device 9 allows a larger amount of gaseous fluid to be injected into the hopper 1 without needing to increase the space 2.7 existing between the tubes 2.8 and 2.9 of the tube 2 (in the case of a coaxial tube), which allows the amount of film used not being increased (if the space 2.7 is increased due to an increase in the diameter of the outer tube 2.8, the film tube surrounding it is larger and therefore requires more film); or it can even reduce the diameter of the tube 2, with the amount of film required for each package being reduced.

Furthermore, as a result of the non-homogeneous accelerations of the product inside the supply conduit 200, which leads to a stretched out form of the product as described, the tube 2 (the inner tube 2.9 in the case of a coaxial tube) may comprise a smaller diameter and either the space 2.7 can be increased if the diameter of the outer tube 2.8 is maintained (offering a better path for the discharge of the gaseous fluid), or else both diameters (or the diameter of the tube 2, if it is not a coaxial tube) can be reduced proportionally, maintaining the same space 2.7, in which case the amount of film needed is reduced.

Preferably, as shown in the Figures, the hopper 1 is the element comprising the passage conduits 201 and 202. The tube 2 can be connected directly to the passage conduits 201 and 202, even though the machine 100 may comprise a hollow intermediate element between the hopper 1 and the tube 2 (the intermediate hopper 8 referred to above, for example).

These and other embodiments are disclosed in the clauses that follow.

Clause 1. Vertical packaging machine comprising a supply conduit (200) through which the product to be packaged falls and an injection device configured for injecting a gaseous fluid into the supply conduit (200), the supply conduit (200) being formed by at least one hopper (1) through which said product to be packaged is introduced in the supply conduit (200) and a tube (2) which is arranged downstream of the hopper (1), characterized in that the supply conduit (200) is divided into at least a first passage conduit (201) with a corresponding central axis (Y201) and a second passage conduit (202) with a corresponding central axis (Y202), in a bifurcation zone (209) which is upstream of the tube (2), said passage conduits (201, 202) being separated from one another such that each passage conduit (201, 202) offers a different path in said bifurcation zone (209) for the product to be packaged, each passage conduit (201, 202) comprising at least a first injection opening (9.1) and a second injection opening (9.2) arranged at different heights and in different angular positions with respect to the corresponding central axis (Y201, Y202), and communicated with the injection device, through which the gaseous fluid enters the supply conduit (200), and said injection device and/or injection openings (9.1, 9.2) being configured for the gaseous fluid to enter the supply conduit (200) in a downward direction.

Clause 2. Vertical packaging machine according to claim 1, wherein each passage conduit (201, 202) comprises more than two injection openings distributed around the corresponding central axis (Y201, Y202).

Clause 3. Vertical packaging machine according to claim 1 or 2, wherein the first passage conduit (201) and the second passage conduit (202) are symmetrical with respect to an axial central plane (P1) of the bifurcation zone (209) of the supply conduit (200).

Clause 4. Vertical packaging machine according to claim 3, wherein the first injection opening (9.1) of each passage conduit (201, 202) is at a lower height than the corresponding second injection opening (9.2) and horizontally closer to the axial central plane (P1) of the bifurcation zone (209) than the corresponding second injection opening (9.2).

Clause 5. Vertical packaging machine according to claim 3, wherein the first injection opening (9.1) of each passage conduit (201, 202) is at a greater height than the corresponding second injection opening (9.2) and horizontally closer to the axial central plane (P1) of the bifurcation zone (209) than the corresponding second injection opening (9.2).

Clause 6. Vertical packaging machine according to any of claims 1 to 5, wherein the injection device is configured for causing, with the injection of the gaseous fluid into the supply conduit (200), at least part of the air present in said supply conduit (200) above the corresponding injection openings (9.1, 9.2) to follow said injected fluid.

Clause 7. Vertical packaging machine according to any of claims 1 to 6, wherein the injection device is configured for directing the gaseous fluid into the supply conduit (200), in a downward direction with an inclination greater than 0° and less than 45° with respect to the vertical.

Clause 8. Vertical packaging machine according to any of claims 1 to 7, wherein the injection device comprises at least a first conduit (108) communicating the passage openings (9.1, 9.2) of the first passage conduit (201) with a source of pressurized gaseous fluid, at least a second conduit (109) communicating the passage openings (9.1, 9.2) of the second passage conduit (202) with said source of pressurized gaseous fluid, and a control unit (300) configured for opening and closing the passage of said gaseous fluid through said conduits (108, 109), gaseous fluid being introduced in the supply conduit (200) through the passage openings (9.1, 9.2) of a passage conduit (201, 202) when the passage of fluid through the corresponding conduit (108, 109) is open.

Clause 9. Vertical packaging machine according to claim 8, wherein the injection device comprises a first chamber (111) around the first passage conduit (201) and communicated with the injection openings (9.1, 9.2) of said first passage conduit (201), and a second chamber (112) around the second passage conduit (202) and communicated with the injection openings (9.1, 9.2) of said second passage conduit (201), the first conduit (108) being communicated with said first chamber (111) and the second conduit (109) being communicated with said second chamber (112).

Clause 10. Vertical packaging machine according to claim 8 or 9, wherein the injection device is configured for injecting the gaseous fluid into the supply conduit (200) at a speed and/or pressure sufficient for causing at least part of the air present in the supply conduit (200) above the corresponding injection openings (9.1, 9.2) to follow said injected fluid.

Clause 11. Vertical packaging machine according to any of claims 1 to 11, wherein the hopper (1) comprises the first passage conduit (201) and the second passage conduit (202).

Clause 12. Vertical packaging machine according to claim 12, comprising an intermediate hopper (8) which is arranged between the hopper (1) and the tube (2) and is part of the supply conduit (200), the bifurcation zone (209) of the supply conduit (200) being arranged in the most downstream part of the hopper (1) and said intermediate hopper (8) being suitable for connecting the tube (2) with the passage conduits (201, 202).

Clause 13. Vertical packaging machine according to any of claims 1 to 12, wherein the tube (2) is a coaxial tube comprising an inner tube (2.9) communicated with the hopper (1) through the inside of which the product to be packaged falls, an outer tube (2.8) having a larger diameter than the inner tube (2.9), and a space (2.7) between said inner tube (2.9) and said outer tube (2.8) which is communicated with the outside of the supply conduit (200).

Clause 14. Vertical packaging machine according to claim 13, comprising an extraction device (9) suitable for extracting the gaseous fluid from the space (2.7) delimited between the inner tube (2.9) and the outer tube (2.8) of the tube (2).

What is claimed is:

1. A vertical packaging machine for packaging a product, the vertical packaging machine comprising:

a supply conduit through which the product to be packaged falls, the supply conduit including a hopper through which the product to be packaged is introduced in the supply conduit and a tube which is arranged downstream of the hopper, the supply conduit including first and second passage conduits, the first passage conduit configured to receive a first part of the product and the second passage conduit configured to receive a second part of the product, the first and second passage conduits respectively having a first central axis and a second central axis, each of the first and second passage conduits being located upstream of the tube, each of the first and second passage conduits including a first gas injection opening and a second gas injection opening arranged at different heights and through which a gas is injected into the first and second passage conduits; and one or more injection devices configured to inject the gas into the first and second passage conduits through the first and second gas injection openings, each of the first and second gas injection openings being configured to deliver the gas in a downward direction into the first and second passage conduits in a manner to assist in causing the product to move downward through the first and second passage conduits and into the tube upon the gas being injected into the first and second passage conduits.

2. The vertical packaging machine according to claim 1, wherein each of the first and second passage conduits includes more than two gas injection openings distributed around the corresponding first and second central axes.

3. The vertical packaging machine according to claim 1, wherein the hopper has a central axis and the first passage conduit and the second passage conduit are arranged symmetrically with respect to the central axis of the hopper.

4. The vertical packaging machine according to claim 3, wherein the first gas injection opening of each of the first and second passage conduits is located below the corresponding second gas injection opening, the first gas injection openings being located horizontally closer to the central axis of the hopper than the corresponding second injection openings.

5. The vertical packaging machine according to claim 4, wherein the one or more injection devices and the first and second gas injection openings are arranged and configured to cause gas located in the supply conduit above the first and second gas injection openings to follow the gas injected by the one or more injection devices into the first and second gas injection openings.

6. The vertical packaging machine according to claim 3, wherein the first gas injection opening of each of the first and second passage conduits is located above the corresponding second injection opening, the first gas injection openings being located horizontally closer to the central axis of the hopper than the corresponding second injection openings.

7. The vertical packaging machine according to claim 1, wherein the one or more injection devices and the first and second gas injection openings are arranged and configured to cause gas located in the supply conduit above the corresponding first and second gas injection openings to follow the gas injected by the one or more injection devices into the first and second gas injection openings.

8. The vertical packaging machine according to claim 1, wherein the first and second gas injection openings are configured to direct the gas into the corresponding first and second passage conduits in a downward direction with an inclination greater than 0° and less than or equal to 45° with respect to the central axis of the hopper.

9. The vertical packaging machine according to claim 1, wherein the one or more injection devices comprise a first conduit communicating the first and second gas injection openings of the first passage conduit with a source of pressurized gas, a second conduit communicating the first and second gas injection openings of the second passage conduit with the source of pressurized gas, and a control unit, each of the first and second conduits including a respective first and second gas shut-off valve, the control unit configured to open and close the first and second gas shut-off valves.

10. The vertical packaging machine according to claim 9, wherein the one or more injection devices comprise a first chamber around the first passage conduit in fluid communication with the first and second gas injection openings of the first passage conduit, and a second chamber around the second passage conduit and in fluid communication with the first and second gas injection openings of the second passage conduit, the first conduit being in fluid communication with the first chamber and the second conduit being in fluid communication with the second chamber.

11. The vertical packaging machine according to claim 9, wherein the one or more injection devices are configured to inject the gas into the supply conduit at a speed and/or pressure sufficient to cause air present in the supply conduit above the corresponding first and second gas injection openings to follow the gas injected into the first and second passage conduits through the first and second gas injection openings.

12. The vertical packaging machine according to claim 10, wherein the one or more injection devices are configured to inject the gas into the supply conduit at a speed and/or pressure sufficient to cause air present in the supply conduit above the corresponding first and second gas injection openings to follow the gas injected into the first and second passage conduits through the first and second gas injection openings.

13. The vertical packaging machine according to claim 1, wherein at least a portion of each of the first and second passage conduits is located inside the hopper.

14. The vertical packaging machine according to claim 1, wherein an entirety of each of the first and second passage conduits is located inside the hopper.

15. The vertical packaging machine according to claim 1, further comprising an intermediate hopper that is arranged between the hopper and the tube and is a part of the supply conduit, an outlet of each of the first and second passage conduits being arranged in a lower part of the hopper, the intermediate hopper fluidly connecting the outlet of each of the first and second passage conduits with the tube.

16. The vertical packaging machine according to claim 15, wherein the tube is a coaxial tube comprising an inner tube in fluid communication with the hopper through the inside of which the product to be packaged falls, an outer tube having a larger diameter than the inner tube, and a space between the inner tube and the outer tube that is in fluid communication with an area outside of the supply conduit.

17. The vertical packaging machine according to claim 1, wherein the tube is a coaxial tube comprising an inner tube in fluid communication with the hopper through the inside of which the product to be packaged falls, an outer tube having a larger diameter than the inner tube, and a space between the inner tube and the outer tube that is in fluid communication with an area outside of the supply conduit.

18. The vertical packaging machine according to claim 17, comprising an extraction device that is fluidly coupled to the space delimited between the inner tube and the outer tube and configured to extract at least a part of the gas injected into the first and second passage conduits.

19. The vertical packaging machine according to claim 18, wherein the one or more injection devices and the first and second gas injection openings are arranged and configured to cause gas located in the supply conduit above the first and second gas injection openings to follow the gas injected by the one or more injection devices into the first and second gas injection openings.

* * * * *